US011208975B2

(12) United States Patent
Meek et al.

(10) Patent No.: US 11,208,975 B2
(45) Date of Patent: Dec. 28, 2021

(54) FUEL INJECTOR

(71) Applicant: Delphi Technologies IP Limited, St. Michael (BB)

(72) Inventors: George A. Meek, Aylburton (GB); Lauren Dransfield, Stroud (GB)

(73) Assignee: DELPHI TECHNOLOGIES IP LIMITED

( * ) Notice: Subject to any disclaimer, the term of this patent is extended or adjusted under 35 U.S.C. 154(b) by 3 days.

(21) Appl. No.: 16/955,404

(22) PCT Filed: Dec. 20, 2018

(86) PCT No.: PCT/EP2018/086122
§ 371 (c)(1),
(2) Date: Jun. 18, 2020

(87) PCT Pub. No.: WO2019/122086
PCT Pub. Date: Jun. 27, 2019

(65) Prior Publication Data

US 2021/0095628 A1 Apr. 1, 2021

(30) Foreign Application Priority Data

Dec. 21, 2017 (GB) ..... 1721637

(51) Int. Cl.
*F02M 61/20* (2006.01)
*F02M 63/00* (2006.01)
*F02M 47/02* (2006.01)

(52) U.S. Cl.
CPC ..... *F02M 63/0045* (2013.01); *F02M 47/02* (2013.01)

(58) Field of Classification Search
CPC .... F02M 47/02; F02M 47/022; F02M 47/025; F02M 47/027; F02M 47/043; F02M 61/10
USPC ..... 239/533.3, 533.8, 533.9, 585.1
See application file for complete search history.

(56) References Cited

U.S. PATENT DOCUMENTS 6,880,766 B2 * 4/2005 Lewis ..... F02M 47/027 239/124
6,945,475 B2 * 9/2005 Lawrence ..... F02M 45/086 239/533.2
6,988,680 B1 1/2006 Boecking
8,448,878 B2 * 5/2013 Ibrahim ..... F02M 63/0043 239/5
10,294,908 B2 * 5/2019 Meek ..... F02M 43/04
2004/0021016 A1 * 2/2004 Wiemken ..... F02M 59/466 239/585.1
2009/0065614 A1 3/2009 Ganser
(Continued)

FOREIGN PATENT DOCUMENTS

DE 102005032464 A1 1/2007
DE 102013112752 A1 5/2015
(Continued)

*Primary Examiner* — John Kwon
(74) *Attorney, Agent, or Firm* — Joshua M. Haines

(57) ABSTRACT

A fuel injector includes a control valve assembly arranged between an actuator assembly and a nozzle assembly. A 3-way valve controls flow for filling or draining a control chamber through a first throttle and through a second throttle for enabling or preventing fuel injection. The second throttle is a through orifice provided in a plate arranged in the control chamber.

10 Claims, 3 Drawing Sheets

(56) References Cited

U.S. PATENT DOCUMENTS

| | | | | |
|---|---|---|---|---|
| 2011/0048379 | A1* | 3/2011 | Sommars | F02M 47/027 123/456 |
| 2013/0112767 | A1* | 5/2013 | Mahmood | F02M 47/027 239/11 |
| 2016/0115924 | A1* | 4/2016 | Meek | F02M 45/00 239/408 |
| 2018/0045153 | A1* | 2/2018 | Harcombe | F02M 63/0063 |

FOREIGN PATENT DOCUMENTS

| | | | |
|---|---|---|---|
| DE | 102015113975 | A1 | 3/2016 |
| DE | 102015113980 | A1 | 3/2016 |

* cited by examiner

FUEL INJECTOR

CROSS REFERENCE TO RELATED APPLICATIONS

This application is a national stage application under 35 USC 371 of PCT Application No. PCT/EP2018/086122 having an international filing date of Dec. 20, 2018, which is designated in the United States and which claimed the benefit of GB Patent Application No. 1721637.5 filed on Dec. 21, 2017, the entire disclosures of each are hereby incorporated by reference in their entirety.

TECHNICAL FIELD

The present invention relates to a fuel injector and more particularly to fuel circuit arrangement enabling asymmetric injection profile without incurring leakage penalty.

BACKGROUND OF THE INVENTION

In a diesel fuel injector, injection events are controlled by a needle with displacements being influenced by the pressure in a control chamber. The needle extends between a tip-end cooperating with a seat to control access to injection holes and an opposite head-end partially defining said control chamber. To fill or to drain the control chamber, and consequently to move the needle, the injector is provided with a 3-way electro-valve controlling fuel flow through a first throttle and through a second throttle.

The valve rests in a filling position wherein pressurised fuel fills the control chamber by flowing through the first throttle and the second throttle. This double (first throttle and second throttle) fuel entry ensures a fast closing of the needle and an abrupt end of injection.

When energised, the valve lifts in a return position wherein the control chamber drains to a return line by flowing through the first throttle only. This single outlet orifice ensures a slower needle lift and a smoother beginning of the injection event but, during this opening phase, both the second throttle and the first throttle are open and pressurised fuel entering via the second throttle directly leaks to the return circuit via the first throttle. This slows the needle opening and generates energy losses. When reaching a fully open position, the head-end of the needle abuts against the ceiling of the control chamber.

While keeping the same injection quantities, the leaks must be reduced or eliminated.

SUMMARY OF THE INVENTION

Accordingly, it is an object of the present invention to resolve the above mentioned problems in providing a fuel injector comprising a control valve assembly arranged between an actuator assembly and a nozzle assembly, wherein a 3-way valve controls the flow for filling or draining a control chamber through a first throttle and through a second throttle for enabling or preventing fuel injection. The control chamber is defined by a bore arranged in a nozzle body, a ceiling face and also by a head-end of needle valve member guided in said bore, said second throttle being a through orifice provided in a plate arranged in said control chamber.

Said bore extends between an open end in an upper face of said nozzle body and a tip-end where injection holes are arranged, the needle valve member being movable between an open position and a closed position of the injection holes and wherein, said plate may be movable in the control chamber between a filling position where the flow has to go through the first throttle only and, a return position where the flow has to go through both the first and second throttles.

Said plate may be annular having a circular outer face adjusted for being guided in the control chamber and a concentric circular inner face defining a central opening through which extends the head-end of the needle valve member.

The head-end of the needle valve member may define an annular shoulder face surrounding a cylindrical member, said member extending through the plate central opening.

The fuel injector may further comprise a spring compressed between said needle shoulder and the under face of said annular plate.

Alternatively, the spring may be compressed between said needle shoulder and a complementary face of the nozzle body.

The invention further extends to a method of operation of a fuel injector described above, the method comprising the following steps:

a1) commanding the 3-way valve to rest in the position wherein a return fluid communication is closed and a filling fluid communication is open enabling pressurised fuel to fill the control chamber by flowing through the first throttle only.

Said commanding step a1) may further comprise the steps:

a2) pushing the plate away from the ceiling face of the control chamber thus dividing the control chamber in an upper compartment and a lower compartment.

Said method may further comprise the steps:

b1) commanding the 3-way valve to move to a second position wherein the filling fluid communication is closed and the return fluid communication is open enabling the control chamber to drain through the first and the second throttles.

Said commanding step b1) may further comprise the step:

b2) urging the plate against the ceiling face of the control chamber.

BRIEF DESCRIPTION OF THE DRAWINGS

The present invention is now described by way of example with reference to the accompanying drawings in which:

FIGS. 2 and 3 are shown twice for clarity purposes.

DESCRIPTION OF THE PREFERRED EMBODIMENTS

Figure 1:
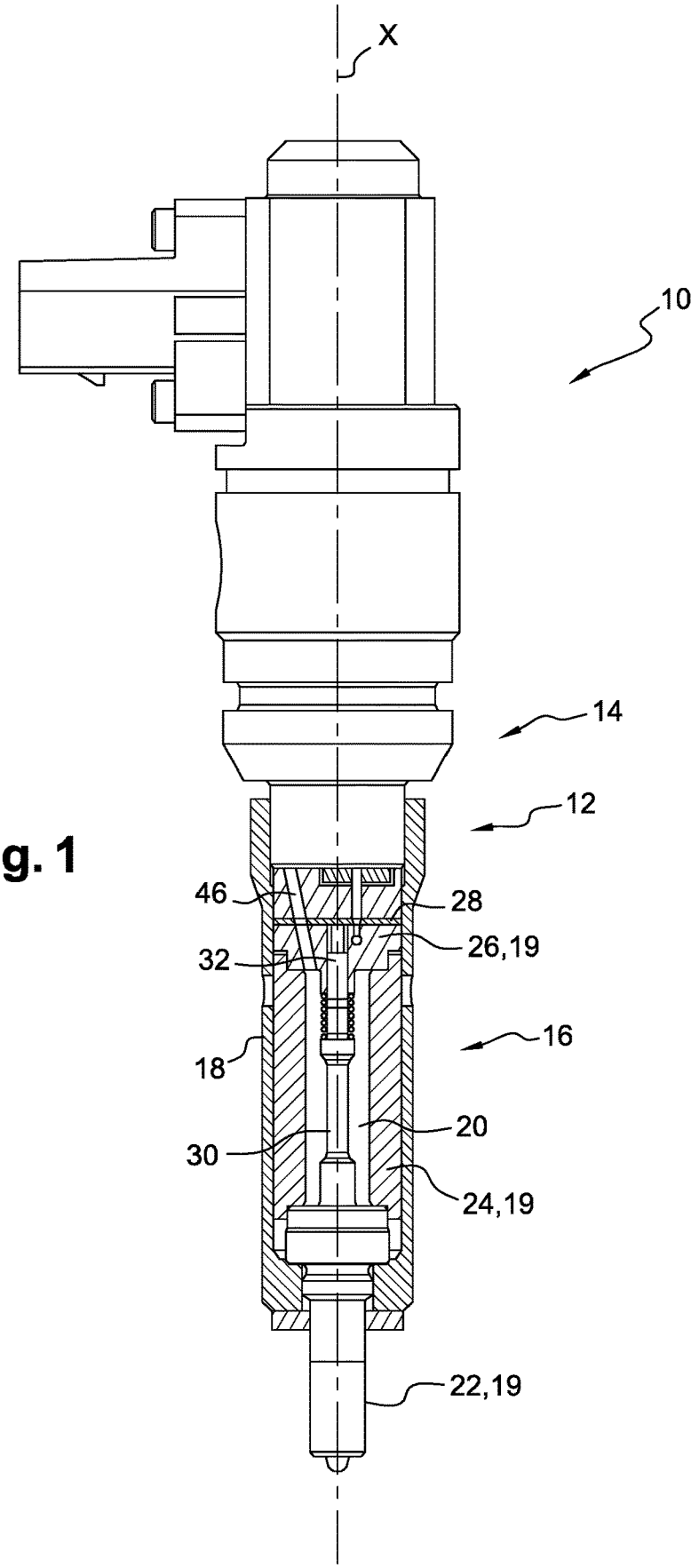
FIG. 1 is an axial section of a fuel injector as per the invention.

A diesel fuel injector 10, presented on FIG. 1, has an elongated shape extending about a main axis X and it comprises a control valve assembly 12 sandwiched between an actuator assembly 14 and a nozzle assembly 16, said three assemblies being fixedly tightened by a capnut 18.

The nozzle assembly 16 has a body 19 provided with an axial bore 20. Depending on the embodiments, said nozzle body 19 may be monobloc or may comprise a plurality of components and, in the present example it is jointly defined by a tip body 22, a barrel member 24 and an upper guide member 26, the bore 20 comprising portions in each of said body members which are being covered at an upper end by an intermediate plate 28 pressed between the upper guide member 26 and the control valve assembly 12.

In said bore 20 a needle valve member 30 is guided between a lower guide member (not shown) and an upper guide defined in the upper guide member 24.

The needle 30 extends between a bottom tip-end (not shown) cooperating with a seat arranged in the tip body 22 to enable or prevent fuel injection through injection holes and, opposite to the tip-end, a head-end 32 is slidably adjusted within the upper guide member 24 portion of the bore, a control chamber 34 being defined between said upper end portion of the bore, said needle head-end 32 and a ceiling face 36 that is the portion of the intermediate plate 28 covering the bore.

The control valve assembly 12 has a cylindrical body 38 provided with a hydraulic bore 40 wherein is guided a stem at an end of which is fixed a magnetic armature cooperating with a coil (not shown) arranged in the actuator assembly 14 and, at the other end is arranged a valve head member protruding outside the body 38 in a valve chamber 42 defined by a through hole arranged in the intermediate plate 28. In said valve chamber 42, the valve head defines a 3-way valve 44.

The injector further defines a high pressure (HP) fuel circuit and a return fuel circuit. The HP circuit comprises a main conduit 46, joining an inlet to said injection holes and a lateral branch joining said main conduit 46 to said control chamber 34 via said valve chamber 42. A portion of the main conduit 46 extends through the valve body 38, through the intermediate plate 28 and through the upper guide member 26 to open in the larger bore of the barrel member 24.

The return circuit extends from the control chamber 34 to an injector outlet port (not shown) also via said valve chamber 42.

Figure 2:
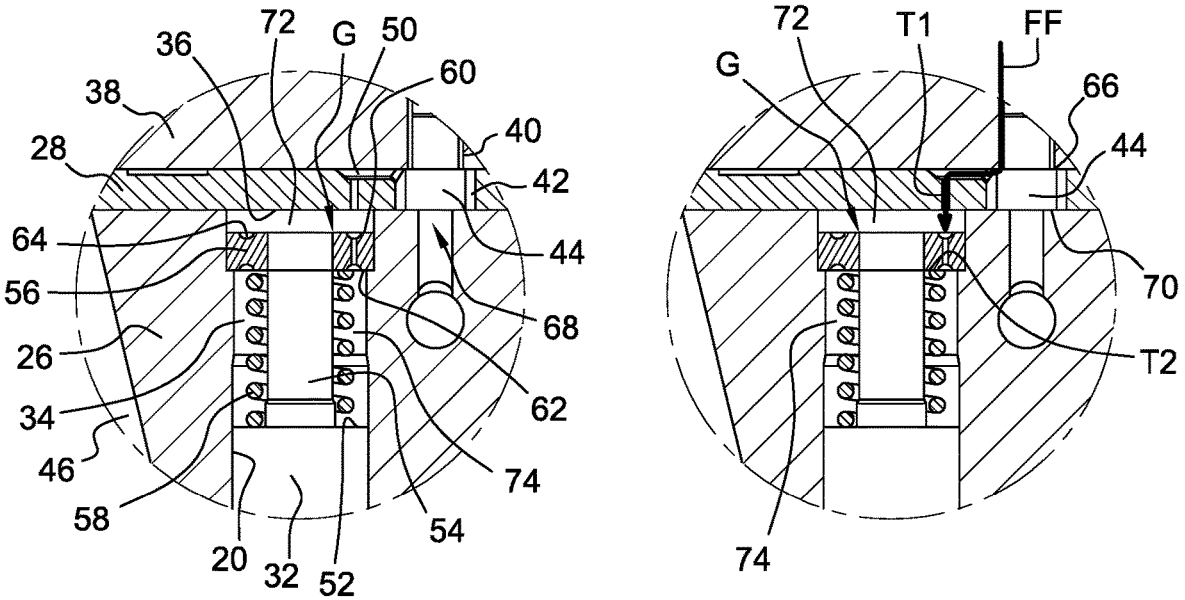
FIG. 2 is a zoom on the area of the control chamber in a position where fuel injection is prevented.
Figure 3:
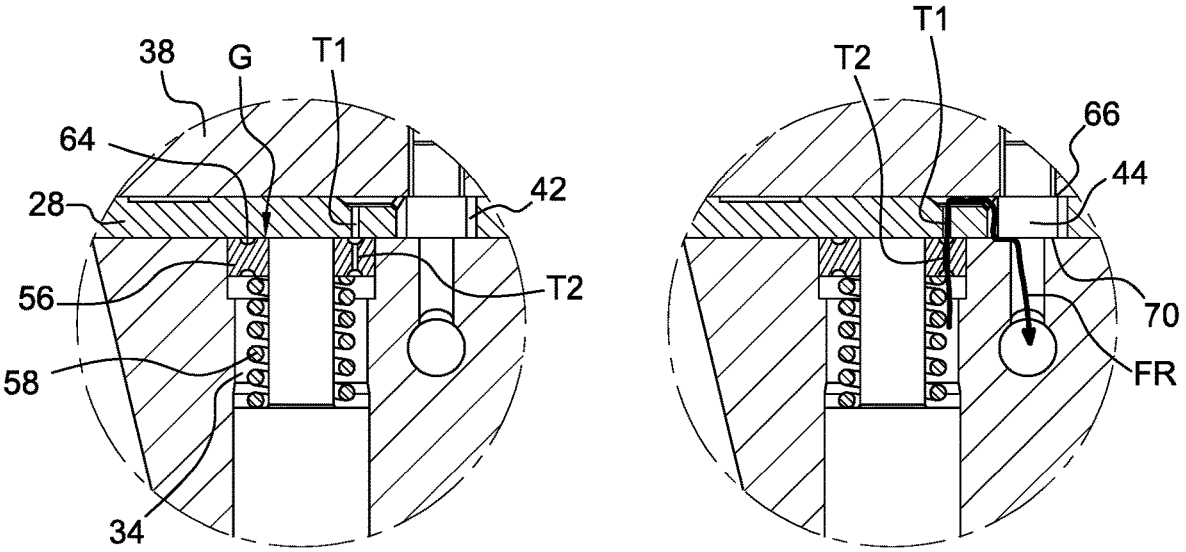
FIG. 3 is similar to FIG. 2, the control chamber being in a position where fuel injection is enabled.

More in details in reference to FIGS. 2, 3, the HP lateral branch extends from the main feed line 46 and, it firstly joins the valve bore 40 wherein pressurised fuel can flow to the valve chamber 42 and, from said valve chamber 42 departs the return line comprising a portion drilled in the upper guide member 26 and centrally opening 68 in the valve chamber 42 opposite to the bore.

The valve chamber 42 is larger than the bore 40 and also larger than the return opening 68, the bore edge defining a filling valve seat 66 and, the annular area surrounding the return opening 68 defining a return valve seat 70. The valve head is a cylindrical member joining the stem via an upper shoulder cooperating with the filling valve seat 66 and, having an under face cooperating with the return seat 70, said arrangement defining said 3-way valve 44 since when one seat is open the other one is closed.

Between the valve chamber 42 and the control chamber 34, the HP circuit and the return circuit share a common portion comprising, a groove 50 dug in the upper face of the intermediate plate 28 and covered by the control valve body 38 thus defining a closed conduit extending between the valve chamber 42 and a distant end where, a first throttle T1 is drilled through the intermediate plate, the first throttle T1 opening in the ceiling 36 of the control chamber.

Extending in the control chamber 34, the final part of the needle head-end 32 is a cylindrical member 54 joining the core of the needle via an annular shoulder defining a needle spring seat 52 surrounding said cylindrical member 54. In the control chamber 34 is further arranged an annular valve plate 56 arranged around the cylindrical member 54, said valve plate 56 having a cylindrical peripheral face slidably adjusted to the bore and, a cylindrical inner face defining an annular gap G with said cylindrical member 54. Between the annular upper face 60 and opposite under face 62 of said valve plate 56 is drilled a second throttle T2 narrower than the first throttle T1 and, in the upper face 60 is dug an annular groove 64 ensuring that when the annular plate 56 has its upper face abutting against the ceiling 36 of the control chamber (FIG. 2), whichever is the angular position of the valve plate 56, the first throttle T1 is always in fluid communication with the second throttle T2.

Also, although not being functionally mandatory a similar groove may be dug on the opposite under face 62 of the plate so that said plate is symmetrical and easier to assemble in the injector.

In the exemplary embodiment, the final portion of the bore wherein is arranged the valve plate 56, defines a recess slightly larger than the rest of the bore. In alternative embodiments there is no recess and the bore has a constant section.

Moreover in the control chamber 34 around said cylindrical member 54, a spring 58 is arranged and compressed between the needle spring seat 52 and the plate member under face 62.

In an alternative embodiment, not shown, the spring could be compressed between the needle spring seat 52 and a complementary face of the nozzle body or of the upper guide member.

Key steps of the operation of the injector 10 are now described.

Firstly, the coil in the actuator assembly is not energised and a spring (not shown) pushes the 3-way valve 44 is in a state opening a filling fluid communication FF that is when the filling seat 66 is open and, closing a return fluid communication FR, that is when the return seat 70 is closed. Pressure in the control chamber 34 is high, the needle is downwardly pushed in a position preventing fuel injection. The valve plate 56 is against the ceiling 36 of the control chamber, the second throttle T2 and the first throttle T1 are in direct fluid communication via the annular groove 64.

Secondly, the coil in the actuator assembly is energised generating a magnetic field attracting the armature-and-stem switching the 3-way valve in a state where the filling seat 66 closes, closing said filling fluid communication FF and, the return seat 70 opens, opening the return fluid communication FR. The fuel exits the control chamber 34 by flowing through the second throttle T2 and through the first throttle T1 prior to joining the groove 50, the valve chamber 42 and flowing through the open return seat 70 toward the return outlet of the injector. As the pressure drops in the control chamber the needle valve member 30 lifts enabling fuel injection through the injection holes and, as shown on FIG. 3, when the opening lift is complete the top of the cylindrical member 54 abuts against the ceiling 36 of the control chamber.

Because the 3-way valve closes the filling seat 66 while it opens the return seat 70 direct leakage during this injection phase is prevented.

In a third step (FIG. 2) energisation of the coil is stopped. The spring (not shown) pushes the 3-way valve back in the state where the filling seat 66 opens, opening the filling fluid communication FF and, the return seat 70 closes, closing the return fluid communication FR. Pressurised fuel enters the control chamber 42 by following in the valve bore 40, through the open filling seat 66, in the groove 50 and through the first throttle T1. In the control chamber 34, the pressurised fuel generates on the upper face 60 of the valve plate, a force overcoming the upward force of the spring 58 and, the annular valve plate 56 is then pushed away from the ceiling face 36 (FIG. 2) further compressing the spring.

The control chamber 34 then divides in an upper compartment 72, between the valve plate 56 and the ceiling 36 and, a lower compartment 74 wherein is compressed the spring 58, between the under face 62 of the valve plate and the needle spring seat 52. The annular gap G between the cylindrical member 54 and the inner face of the valve plate 56 is large enough and does not restrict fuel flow between said upper 72 and lower 74 compartments therefore, after said vale plate 56 has moved away from the ceiling the pressure rises in the lower compartment 74 and generates on the needle valve member 30 a first closing force on the top face of the cylindrical member and, a second closing force on shoulder of the valve plate. Said combined forces downwardly push the needle toward a closed position of the injection holes. When the pressure in the upper 72 and the lower 74 compartments equalizes, the spring 58 pushes the valve plate 56 back against the ceiling face 36.

In the alternative where the spring is compressed between the needle and a shoulder of the bore, the displacement of the valve plate does not further compress the spring.

Figure 4:
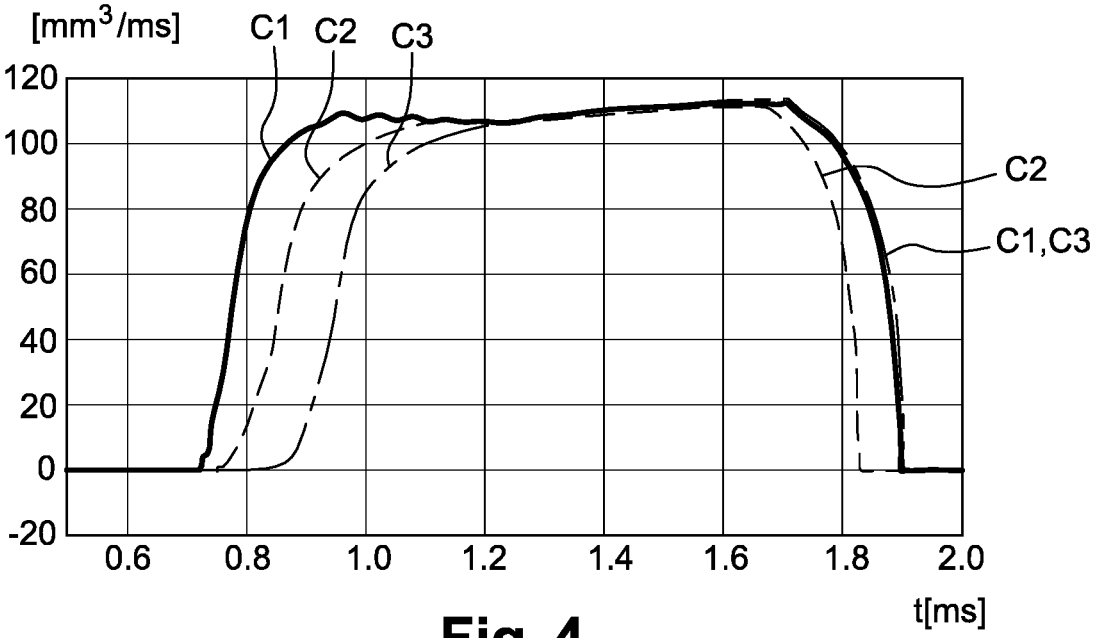
FIG. 4 is an X-Y plot of the fuel injection quantity during an injection event.
Figure 5:
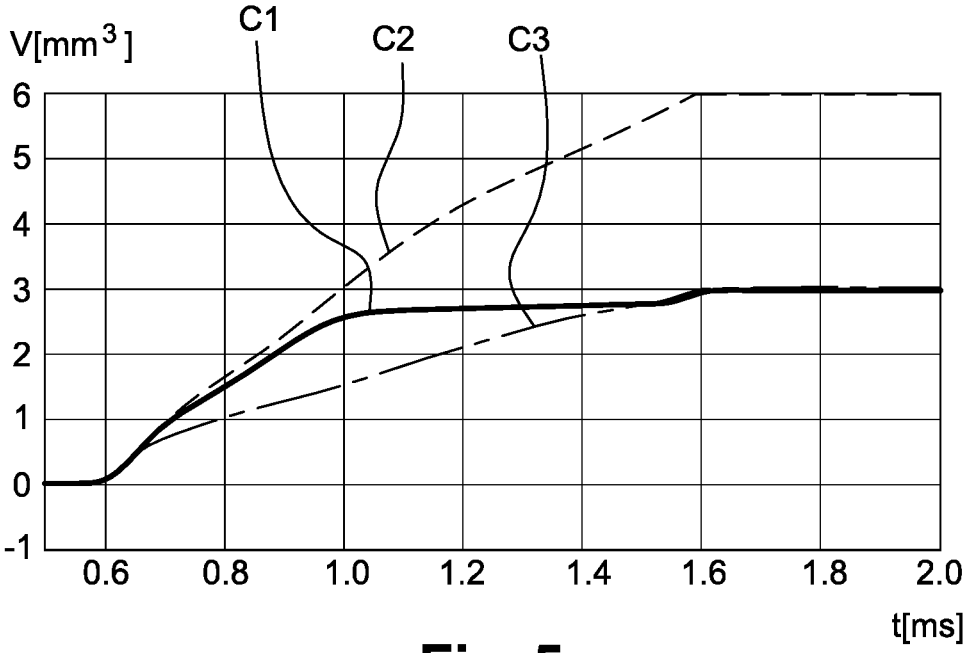
FIG. 5 is an X-Y plot of the leaks occurring during an injection event.

FIGS. 4 and 5 are plots for injectors of the prior art having only a first throttle (plot C1), a first throttle and a second throttle but leaking during the injection phase (plot C2) and of the present invention (plot C3). FIG. 4 is an X-Y chart where are plotted the injected flow rates [mm3/ms] as a function of the injection time [ms] and, FIG. 5 is an X-Y chart where are plotted the leaking volume [cm3] as a function of the injection time [ms] with same scale as FIG. 4.

The plot C3 of the present invention demonstrates that at beginning of the an injection, the opening of the needle 30 has a similar slope as the other plots, C1, C2 but it is damped because the control chamber drains through both the second throttle and the first throttle and the 3-way valve prevents leakage (FIG. 5), as happening in plot C2.

During the injection, the injected rates are identical because the needle lift is the same, since a full lift is enabled by the annular shape of the valve plate 56, the needle head abutting the ceiling of the control chamber when fully opening.

The injection ending of the injector of the present invention is similar to injectors just having a first throttle, the valve plate 56 dividing the control chamber in a way that the control chamber only fills through the first throttle.

LIST OF REFERENCES

X main axis
T1 first throttle
T2 second throttle
FF filling fluid communication
FR return fluid communication
10 injector
12 control valve assembly
14 actuator assembly
16 nozzle assembly
18 capnut
19 nozzle body
20 bore
22 tip body
24 barrel member
26 upper guide member
28 intermediate plate
30 needle valve member
32 head-end of the needle
34 control chamber
36 ceiling face
38 body of the control valve
40 valve bore
42 valve chamber
44 3-way valve
46 main feed line
50 groove
52 needle spring seat
54 cylindrical member
56 plate—valve plate
58 spring
62 plate under face
60 plate upper face
64 annular groove
66 filling valve seat
68 return hole
70 return valve seat
72 upper compartment
74 lower compartment

The invention claimed is:

1. A fuel injector comprising:

a control valve assembly arranged between an actuator assembly and a nozzle assembly; and a 3-way valve which controls flow for filling or draining a control chamber through a first throttle and through a second throttle which enables or prevents fuel injection, the control chamber being defined by a bore arranged in a nozzle body, by a ceiling face, and also by a head-end of a needle valve member guided in said bore, said second throttle being a through orifice provided in a plate arranged in said control chamber.

2. A fuel injector as claimed in claim 1, wherein said bore extends between an open end in an upper face of said nozzle body and a tip-end where injection holes are arranged, the needle valve member being movable between an open position and a closed position of the injection holes and wherein, said plate is movable in the control chamber between a filling position where the flow has to go through the first throttle only and, a return position where the flow has to go through both the first throttle and the second throttle.

3. A fuel injector as claimed in claim 2, wherein said plate is annular having a circular outer face adjusted for being guided in the control chamber and a concentric circular inner face defining a central opening through which extends the head-end of the needle valve member.

4. A fuel injector as claimed in claim 3, wherein the head-end of the needle valve member defines an annular shoulder face surrounding a cylindrical member, said cylindrical member extending through the central opening of the plate.

5. A fuel injector as claimed in claim 4 further comprising a spring compressed between said annular shoulder face and an under face of said plate.

6. A method of operation of the fuel injector as claimed in claim 5, the method comprising the following step:

1) commanding the 3-way valve to rest in a position wherein a return fluid communication is closed and a filling fluid communication is open, thereby enabling pressurised fuel to fill the control chamber by flowing through the first throttle only.

7. A method as claimed in claim 6, wherein said commanding step 1) further comprises the step:

2) pushing the plate away from the ceiling face of the control chamber, thus dividing the control chamber into an upper compartment and a lower compartment.

8. A method as claimed in claim 7 further comprising the step:

3) commanding the 3-way valve to move to a second position, wherein the filling fluid communication is closed and the return fluid communication is open, thereby enabling the control chamber to drain through the first throttle and the second throttle.

9. A method as claimed in claim 8, wherein said commanding step 3) further comprises the step:

4) urging the plate against the ceiling face of the control chamber.

10. A method as claimed in claim 6 further comprising the step:

2) commanding the 3-way valve to move to a second position, wherein the filling fluid communication is closed and the return fluid communication is open, thereby enabling the control chamber to drain through the first throttle and the second throttle.

* * * * *